US006687192B2

(12) United States Patent
Bettelini et al.

(10) Patent No.: US 6,687,192 B2
(45) Date of Patent: Feb. 3, 2004

(54) TIMEPIECE MOVEMENT

(75) Inventors: Marco Bettelini, Prêles (CH); Theodor Schoenenberger, Bellach (CH)

(73) Assignee: Eta Sa Fabriques d'Ebauches, Grenchen (CH)

( * ) Notice: Subject to any disclaimer, the term of this patent is extended or adjusted under 35 U.S.C. 154(b) by 176 days.

(21) Appl. No.: 10/060,175

(22) Filed: Feb. 1, 2002

(65) Prior Publication Data

US 2002/0141292 A1 Oct. 3, 2002

(30) Foreign Application Priority Data

Apr. 3, 2001 (CH) ..... 0629/01

(51) Int. Cl.[7] ..... G04B 19/02; G04B 29/00
(52) U.S. Cl. ..... 368/220; 368/323
(58) Field of Search ..... 368/220, 322, 368/323, 76, 80

(56) References Cited

U.S. PATENT DOCUMENTS 4,636,087 A 1/1987 Suzuki
4,785,434 A * 11/1988 Shoji et al. ..... 368/185
4,795,930 A * 1/1989 Schwartz et al. ..... 310/49 R
4,805,161 A * 2/1989 Kroner ..... 368/220
5,155,712 A 10/1992 Mose et al.

FOREIGN PATENT DOCUMENTS

CH 212 585 A 11/1940
FR 2 433 194 A 7/1980

* cited by examiner

*Primary Examiner*—Vit Miska
(74) *Attorney, Agent, or Firm*—Sughrue Mion, PLLC

(57) ABSTRACT

The invention concerns the structure of a timepiece movement, more particularly the structure of the hour wheel (1), the inside of whose pipe (4) includes an annular bulge (6) co-operating with an annular groove (22) arranged on the outer wall of the pipe (21) of the cannon-pinion (7). Thus, the hour wheel is snap-fitted onto the movement, without it being necessary to provide an additional part for this purpose, and its toothed wheel (3) cannot therefore be released from the motion-work pinion (19) during transport of the movement.

17 Claims, 2 Drawing Sheets

TIMEPIECE MOVEMENT

The present invention concerns a timepiece movement including a plate, a display device with hands, a gear train connecting drive means to said hands, said train including a drive wheel meshed at least indirectly with said drive means and secured to a cannon-pinion pivoting on a post mounted in a gear train bar, an hour wheel arranged around the cannon-pinion and resting on the plate, the drive wheel and the hour wheel extending respectively on either side of said plate.

This type of timepiece movement is common and has been known for a long time. However, it should be noted that the movements of the prior art have certain drawbacks, which the present invention can overcome.

Figure 1:
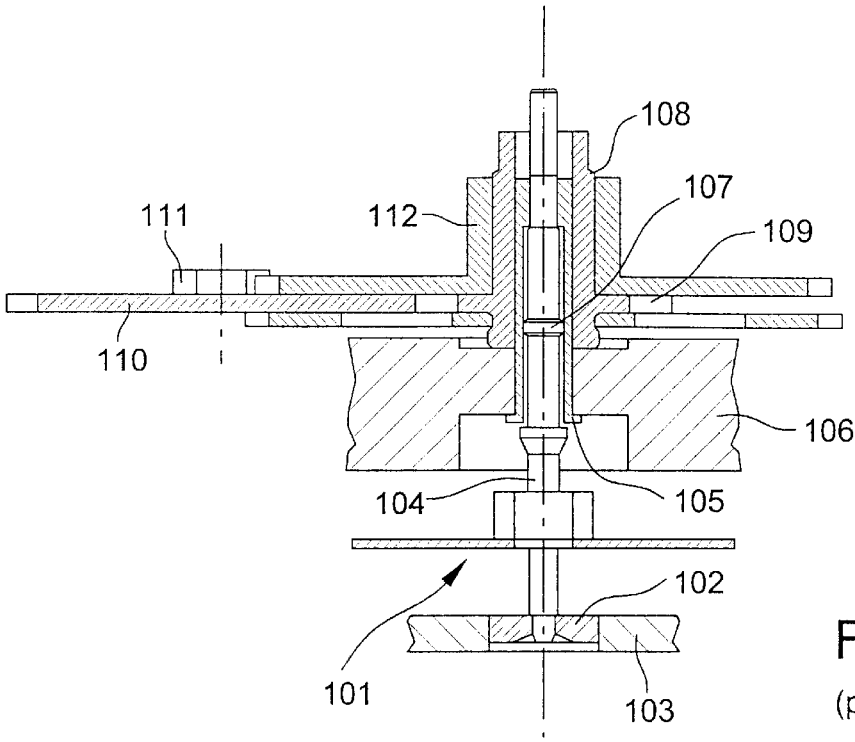
Fig. 1 (prior art)

FIG. 1 shows schematically a part of a movement with centre-seconds as disclosed in the prior art. FIG. 1 shows the relative positions of the hour display wheel sets. In particular, a seconds wheel set 101 can be seen, mounted so as to pivot in a jewel 102, which is itself driven into a gear train bar. The arbour 104 of the seconds wheel set is disposed in a central pipe 105, said central pipe 105 being driven through a plate 106. The seconds arbour 104 includes, in its median part, an annular raised portion 107 whose diameter is substantially equal to the inner diameter of central pipe 105. Said central pipe 105 fulfills thus the function of radial guide for the second arbour 104. Cannon-pinion 108 is rotatably mounted on said central pipe 105, the base of cannon-pinion 108 resting on the top of plate 106. It should be noted that central pipe 105 also fulfils the function of a radial guide for cannon-pinion 108. The pinion of cannon-pinion 108 meshes with a motion-work wheel 110, secured to a motion-work pinion 11 which meshes with an hour wheel 112. Said hour wheel 112 is rotatably mounted on cannon-pinion 108 which thus acts as its radial guide.

A first drawback of this type of movement is clear from FIG. 1 and concerns timepiece movement manufacturers, in particular when they deliver such movements to clients who then encase them in watch cases of their choice. Indeed, in a conventional manner, whereas all of movement gear train is enclosed between a plate and bars, the hour wheel is disposed on said plate, and thus outside the movement. Moreover, given that said hour wheel has to be free to rotate about the cannon-pinion, it is typically simply slipped onto said cannon-pinion and is thus free axially. Consequently, the hour wheel is capable of becoming unmeshed from the motion-work pinion during transport from the movement manufacturer to the client. More precisely, during the timepiece assembly process, the dial is generally pressed onto the movement. If, during this step, the hour wheel is not properly meshed with the motion-work pinion, the teeth of the hour wheel can be deformed because of pressure against against the motion-work pinion. In the case of inexpensive movements, the hour wheel is sometimes made of plastic material and its teeth are then likely to break when the dial is set in place, if the toothing of the hour wheel is not properly meshed with the motion-work pinion toothing. The client is obliged, prior to setting the dial in place, to check automatically or manually that the hour wheel is properly positioned, if he wishes to avoid risking any malfunction of the timepiece, following damage to the movement. This unavoidable checking step involves an increase in the duration and cost of manufacture of the finished product.

Likewise, the hour wheel may come entirely free of the cannon-pinion and get lost during transport of the movements to the encasing station, which also involves additional production costs.

A known solution of the prior art for overcoming this problem consists in adding a washer to the cannon-pinion pipe once the hour wheel is set in place, so as to lock the latter axially. However this solution has a drawback in that it requires the manufacture of an additional part, typically a washer, and the implementation of an additional step in the movement assembly process, in order to mount said washer.

The main object of the present invention is thus to overcome the drawbacks of the aforementioned prior art by providing a timepiece movement, allowing in particular the hour wheel to be kept meshed with the motion-work pinion during transport of the movements before the encasing operation.

The invention therefore concerns a timepiece movement of the aforementioned type, characterised in that the hour wheel and the cannon-pinion respectively include complementary means for holding the hour wheel axially on the cannon-pinion.

The structure according to the invention prevents the hour wheel coming free of the cannon-pinion during the transport step and thus being lost or damaged when the dial is set in place, while omitting the aforementioned checking step.

An additional advantage of the invention stems from the fact that the means for holding the hour wheel on the cannon-pinion pipe form an integral part of these two elements. Manufacture of the holding means thus does not necessitate implementation of an additional step, as such, in the movement manufacturing process.

According to a particular embodiment of the invention, said holding means are of the snap fitting type. They may include in particular a complementary bulge and groove, respectively arranged on the pipe of the hour wheel and on the cannon-pinion tube, for example.

An additional advantage of the present invention resides in the fact that said bulge is made by an over-thickness of material on the hour wheel pipe, said over-thickness being located substantially where the hour hand is subsequently driven in. Indeed, driving in a hand generally causes a plastic flow of material onto its support which may increase over time. This phenomenon may create play between the hand and its support, or even cause the hand to become detached from its support. Owing to the structure of the hour wheel pipe according to the invention, in particular owing to said over-thickness, the plastic flow of material on the tube is limited and the hour hand is held securely over time.

Another drawback of the movements of the prior art such as that shown in FIG. 1 concerns manufacturing tolerances to be taken into account for making the various parts forming the movement. More particularly here, the tolerances on the radial dimensions of the seconds wheel set 101, central pipe 105, cannon-pinion 108 and hour wheel 112 are of great importance. Indeed, these different parts have to be both free to rotate with respect to each other and act as a radial guide for each other. The drawback of such a structure is that uncertainties as to the radial dimensions of a part, directly linked to tolerances accepted by the manufacturer, will be added to radial uncertainties existing on the following part, and so on. Globally, the sum of all these uncertainties may lead to a finished product of mediocre manufacturing quality, because of a significant radial play of the arbour of the hour hand for example.

An obvious solution allowing this problem to be overcome consists in reducing the accepted manufacturing tolerances for the movement parts, which has the result of limiting radial uncertainties and thus the final play of the hour hand arbour. However, limiting tolerances, however slightly, causes significant increases in production costs, which is unsuitable for the manufacture of inexpensive movements.

Another object of the present invention is to overcome the aforementioned drawbacks of the prior art by providing a timepiece movement of acceptable manufacturing quality at a low cost price.

The invention thus also concerns a timepiece movement of the aforementioned type, characterised in that it does not include a central pipe and that an annular shoulder is provided on the movement plate acting as a radial guide for the hour wheel. Thus the global radial uncertainty is greatly reduced with respect to that of movements of the prior art insofar as a part, and thus its accompanying uncertainty, is omitted. The economic importance of the simple fact of omitting one part from a movement, should be recalled here, more particularly when it is an inexpensive movement manufactured in batches of at least several hundred thousand or several million.

Moreover, the various aforementioned uncertainties have been in part disassociated insofar as the cannon-pinion no longer fulfils the function of radial guide for the hour wheel. Consequently, the radial play existing as regards the hour wheel in no way depends upon the radial uncertainties inherent in the manufacture of the seconds wheel set and cannon-pinion. Thus, the radial play of the arbour of the hour hand can be suitably controlled, independently of the uncertainties existing as regards the seconds wheel set and cannon-pinion.

Figure 2:
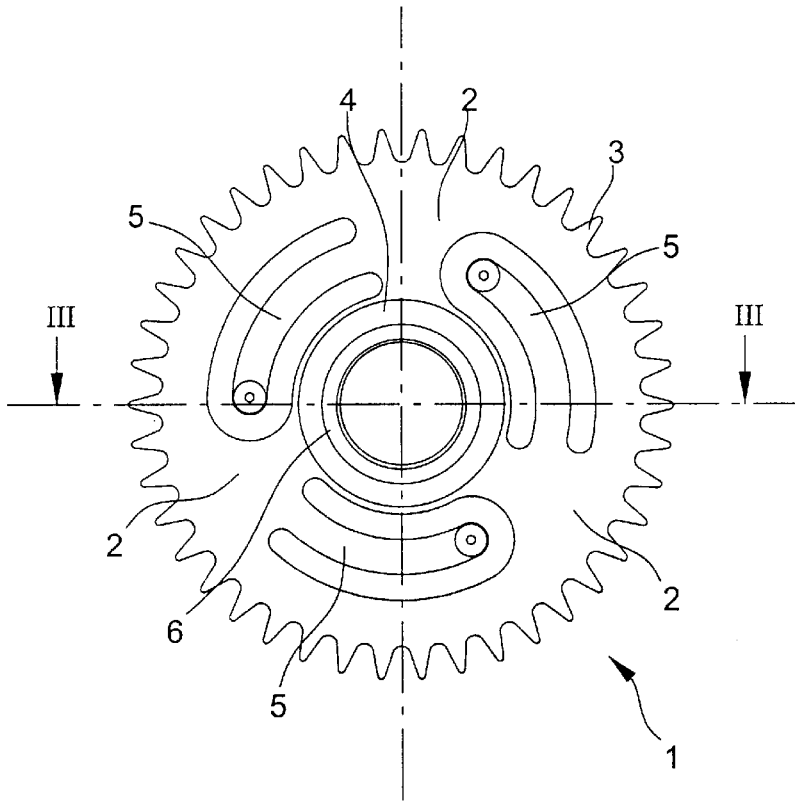
Figure 3:
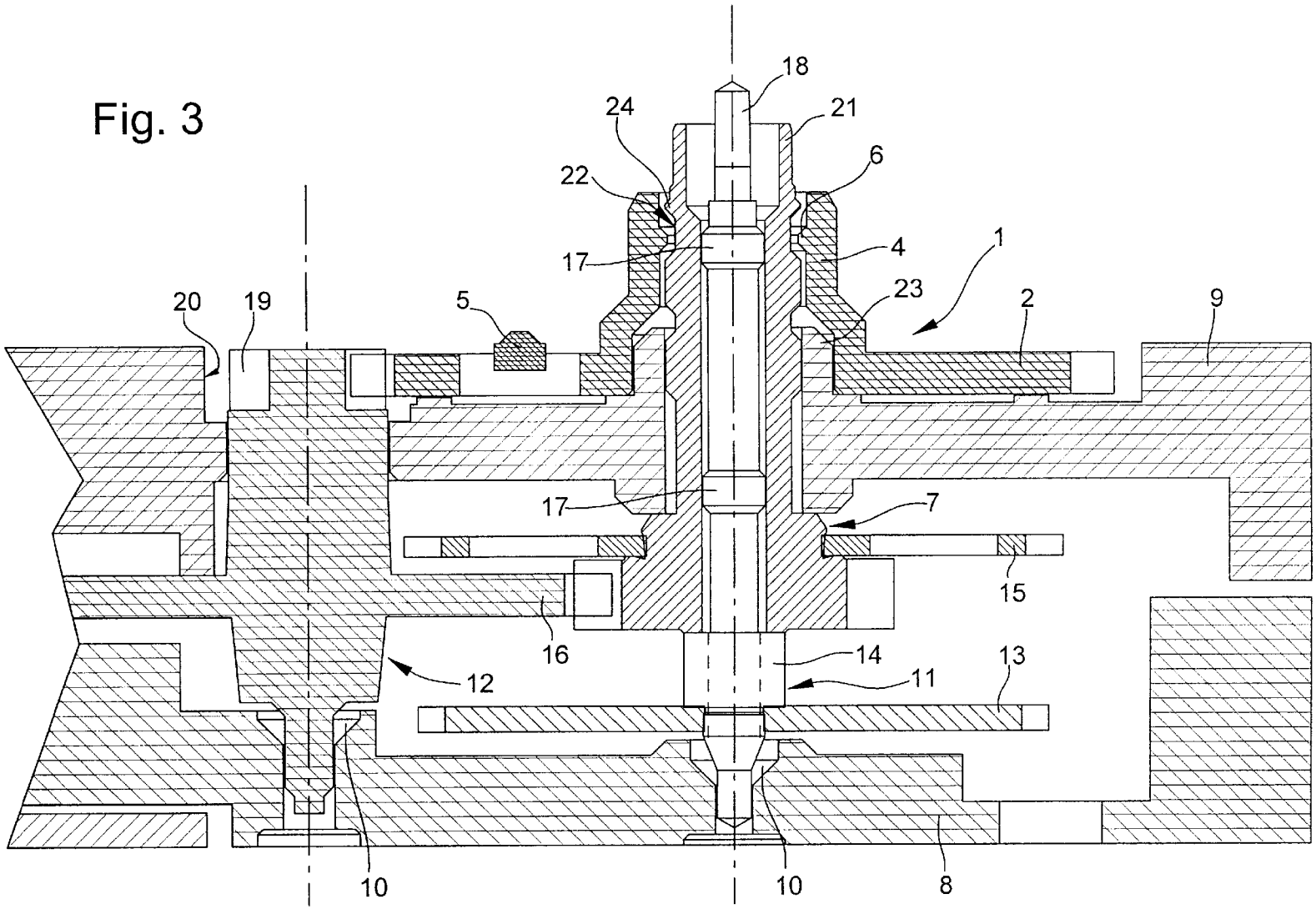

The invention will be better understood with the aid of the following description of an example embodiment with reference to the annexed drawings, in which:

FIG. 2 is a top view of a particular embodiment of the hour wheel according to the invention; and FIG. 3 is a cross-section of a part of the timepiece movement along the line III—III of FIG. 2.

As appears in FIG. 2, hour wheel 1 has a conventional structure. Three radial extensions 2 connect toothed wheel 3 to cannon 4. In the particular embodiment shown in FIG. 2, it will be noted that three arms 5, substantially in the shape of an arc of a circle, each extend from one of said radial extensions 2. These arms 5 have the function of adjusting the relative vertical positioning of hour wheel 1 and the cannon-pinion (not shown in this Figure) thus allowing a metal foil spring, usually used to assure this function, to be omitted.

FIG. 2 also shows the particular features of hour wheel 1, namely the fact that the inside of its cannon 4 includes an annular bulge 6.

FIG. 3 allows the advantage of said bulge 6 to be better understood, since it is shown in its active position, i.e. when hour wheel 1 is arranged on cannon-pinion 7.

The timepiece movement partially visible in this Figure is of the type with centre-seconds. In particular, a gear train bar 8 and a plate 9 defining a cage containing the essential movement elements can be seen. Gear train bar 8 carries jewels 10, in which wheel sets are mounted so as to pivot. In particular, a centre-seconds wheel set 11 and a motion-work wheel set 12 can be seen. Seconds wheel set 11 is driven by an escapement pinion (not shown) by the intermediary of seconds wheel 13. Seconds pinion 14 meshes with a third wheel (not shown) secured to a third pinion (not shown) which is meshed with drive wheel 15, friction fitted on cannon-pinion 7. Cannon-pinion 7, disposed directly on seconds wheel set 11, then transmits its rotational movement to motion-work 12 via motion-work wheel 16. Cannon-pinion 7 is guided radially directly by seconds wheel set 11 by two annular bulges 17 arranged on second arbour 18. Motion-work pinion 19, passing through an orifice 20 arranged through plate 9, is meshed with hour wheel 1, disposed on top of said cage, and it communicates its rotational movement to it.

FIG. 3 clearly shows that said hour wheel 1 is mounted so as to rotate freely on cannon-pinion 7. Hour wheel 1 and cannon-pinion 7 respectively include complementary means for holding said hour wheel 1 axially on cannon-pinion 7, in particular during transport. Said complementary means are of the snap-fitting type, more precisely, cannon-pinion pipe 21 includes an annular groove 22 of complementary shape facing bulge 6 of hour wheel 1.

The outer face of plate 9 further includes an annular shoulder 23 acting as a radial positioning guide for said hour wheel 1.

It is clear that hour wheel 1 is set in place on cannon-pinion 7 by "snap-fitting", i.e. by the resilient deformation of material. Indeed, hour wheel 1 is first of all slipped onto cannon-pinion 7 until bulge 6 of the hour wheel abuts against a bulge 24 located immediately above groove 22 of cannon-pinion pipe 21. At this stage, a slight pressure on hour wheel 1 causes the resilient deformation of cannon 4, allowing bulge 6 to clear said bulge 24 and to fit into groove 22, which sets said hour wheel 1 in place on plate 9. Consequently, said hour wheel 1 cannot release itself from its place during transport. It should be noted that the step of setting hour wheel 1 in place on cannon-pinion 7 does not require any modification to the conventional assembly process, because of the simplicity and ingenuity of holding means 6, 22.

An additional detail may also be noted in the structure of hour wheel 1. As was indicated previously, annular bulge 6 arranged in pipe 4 of hour wheel 1 is formed of an over-thickness of material and not simply by deformation. This feature has the significant result that the plastic flow of material which occurs, when the hour hand is set in place (not shown), is localised at said over-thickness. The deformation experienced by hour wheel 1 during this assembly step is thus limited to this region. Moreover, once the hand is in place, the plastic flow of material continues slowly over time and the existence of said over-thickness, disposed at the same place as the hand, means that the positioning of the hand is better maintained over time than in the case of a conventional hour wheel pipe.

Said snap-fitting may also be reversed, according to an alternative embodiment, by arranging bulge 6 on cannon-pinion 7 and groove 22 on hour wheel 1, although this alternative is less advantageous than that described hereinbefore. Indeed, in such case, the advantage, described hereinbefore, arising from the existence of an over-thickness of material on pipe 4 of hour wheel 1, is lost, which consequently leads to a decrease in the proper holding of the hour hand over time.

According to a particular embodiment, motion-work wheel 12 is preferably made of steel, brass or plastic material, whereas the cannon-pinion 7 is made of steel or brass and hour wheel 1 is made of plastic material, such as polyoxymethylene or a polyacetal. These examples of materials are not, of course, limiting and those skilled in the art can use any other material capable of assuring the same functions.

The particular features of the timepiece movement according to the invention should also be noted, such features also being visible in FIG. 3. It may first of all be noted that because of the absence of the central pipe, the uncertainty as to the radial dimensions linked to this part is removed compared to movements of the prior art including a central pipe. The fact of having one part less compared to movements of the prior art also constitutes an economic advantage insofar as this contributes to lowering the cost price of the movement. This saving comprises two aspects, since on the one hand the manufacturer has one part less to manufacture than usual and on the other hand the assembly process includes one step less.

Further, as was described hereinbefore, hour wheel 1 is guided radially by an annular shoulder 23 arranged on the top of plate 9 and no longer by cannon-pinion 7, as is typically the case in the prior art. The fact of having significant uncertainties as to the radial dimensions of the second arbour 18 and cannon-pinion pipe 21 no longer has any effect on the free rotation of hour wheel 1 owing to the structure according to the invention, visible in FIG. 3. This peculiarity allows the manufacturer to be satisfied with relatively high tolerances, as regards the radial dimensions of second arbour 18, cannon-pinion pipe 21 and pipe 4 of hour wheel 1. This technical advantage also contributes to lowering the cost price of the movement according to the invention and thus allows inexpensive movements to be made.

The preceding description relates to preferred embodiments of the invention and should in no way be considered as limiting, as regards more particularly the nature of the materials used.

Furthermore, the movement described here is of the type with centre seconds but the structure according to the invention may of course be adapted to a movement without centre seconds, wherein the seconds wheel is simply replaced by a central post.

It will be understood that the invention is in no way limited to this single embodiment and that it may advantageously be applied to any electronic or electromechanical timepiece including at least an analogue type display.

What is claimed is:

1. A timepiece movement including a plate, a display device with hands, a gear train connecting drive means to said hands, said train including a drive wheel meshed at least indirectly with said drive means and secured to a cannon-pinion pivoting on a post mounted in a gear train bar, an hour wheel arranged around the cannon-pinion and resting on the plate, the drive wheel and the hour wheel extending respectively on either side of said plate, wherein the hour wheel and the cannon-pinion respectively include complementary means for holding the hour wheel axially on the cannon-pinion.

2. The timepiece movement according to claim 1, wherein said holding means are of the snap-fitting type.

3. The timepiece movement according to claim 2, wherein said holding means include a complementary annular bulge and groove one of which is arranged on the cannon-pinion and the other on the hour wheel.

4. The timepiece movement according to claim 3, wherein said bulge and said groove are respectively arranged on the hour wheel and the cannon-pinion.

5. The timepiece movement according to claim 4, wherein said annular bulge is formed of an over-thickness of material of the hour wheel.

6. The timepiece movement according to claim 1, wherein said hour wheel is free to rotate on itself and is not in contact with the cannon-pinion.

7. The timepiece movement according to claim 3, wherein said hour wheel is free to rotate on itself and is not in contact with the cannon-pinion.

8. The timepiece movement according to claim 5, wherein said hour wheel is free to rotate on itself and is not in contact with the cannon-pinion.

9. The timepiece movement according to claim 1, wherein the plate includes an annular shoulder acting as a radial guide for the hour wheel.

10. The timepiece movement according to claim 4, wherein the plate includes an annular shoulder acting as a radial guide for the hour wheel.

11. The timepiece movement according to claim 7, wherein the plate includes an annular shoulder acting as a radial guide for the hour wheel.

12. The timepiece movement according to claim 8, wherein the plate includes an annular shoulder acting as a radial guide for the hour wheel.

13. The timepiece movement according to claim 1, wherein the hour wheel is made of plastic material.

14. The timepiece movement according to claim 8, wherein the hour wheel is made of plastic material.

15. The timepiece movement according to claim 12, wherein the hour wheel is made of plastic material.

16. The timepiece movement according to claim 12, wherein it further includes a seconds wheel set and in that said post is the arbour of said seconds wheel set.

17. The timepiece movement according to claim 15, wherein it further includes a seconds wheel set and in that said post is the arbour of said seconds wheel set.

* * * * *